US010435828B2

(12) United States Patent
Koeckritz et al.

(10) Patent No.: US 10,435,828 B2
(45) Date of Patent: Oct. 8, 2019

(54) FABRIC BELT FOR PRODUCING WEB MATERIAL, IN PARTICULAR FOR PRODUCING SPUNBONDED FABRIC

(71) Applicant: VOITH PATENT GMBH, Heidenheim (DE)

(72) Inventors: Uwe Koeckritz, Heidenheim (DE); Juergen Abraham, Nattheim (DE); Antony Morton, Ben Rhydding (GB)

(73) Assignee: Voith Patent GmbH, Heidenheim (DE)

( * ) Notice: Subject to any disclaimer, the term of this patent is extended or adjusted under 35 U.S.C. 154(b) by 235 days.

(21) Appl. No.: 15/500,177

(22) PCT Filed: Jul. 29, 2015

(86) PCT No.: PCT/EP2015/067349

§ 371 (c)(1),
(2) Date: Jan. 30, 2017

(87) PCT Pub. No.: WO2016/020230

PCT Pub. Date: Feb. 11, 2016

(65) Prior Publication Data

US 2017/0260664 A1 Sep. 14, 2017

(30) Foreign Application Priority Data

Aug. 7, 2014 (DE) ..... 10 2014 215 656

(51) Int. Cl.
*D04H 3/02* (2006.01)
*D03D 3/04* (2006.01)

(52) U.S. Cl.
CPC ..... *D04H 3/02* (2013.01); *D03D 3/04* (2013.01)

(58) Field of Classification Search
CPC ..... D03D 3/04; D04H 3/02
See application file for complete search history.

(56) References Cited

U.S. PATENT DOCUMENTS

| | | | |
|---|---|---|---|
| 4,981,745 | A | 1/1991 | Lefkowitz |
| 7,172,982 | B2 | 2/2007 | Jaglowski et al. |
| 2007/0023147 | A1 | 2/2007 | Neumann |

FOREIGN PATENT DOCUMENTS

| | | | |
|---|---|---|---|
| EP | 1749653 | A2 | 2/2007 |
| GB | 1058616 | A | 2/1967 |
| WO | 2005013873 | A1 | 2/2005 |

*Primary Examiner* — Arti Singh-Pandey
(74) *Attorney, Agent, or Firm* — Laurence A. Greenberg; Werner H. Stemer; Ralph E. Locher

(57) ABSTRACT

A woven-fabric belt for producing web material, in particular for producing spunbonded fabric, with a plurality of longitudinal threads, running substantially in a longitudinal belt direction, and a plurality of transverse threads, running substantially in a transverse belt direction. The longitudinal threads bind with the transverse threads at binder points, and crown regions of the longitudinal threads are formed on a web-material contacting side. On the web-material contacting side a multiplicity of deposits are provided at least on the longitudinal threads. The deposits do not extend into crown regions and/or deposits which do extend into crown regions in the longitudinal belt direction are asymmetrical in relation to a respective crown region.

20 Claims, 1 Drawing Sheet

FABRIC BELT FOR PRODUCING WEB MATERIAL, IN PARTICULAR FOR PRODUCING SPUNBONDED FABRIC

BACKGROUND OF THE INVENTION

Field of the Invention

The present invention relates to a woven-fabric belt for producing web material, in particular for producing spunbonded fabric, comprising a plurality of longitudinal threads, running substantially in a longitudinal belt direction, and a plurality of transverse threads, running substantially in a transverse belt direction, wherein the longitudinal threads bind with the transverse threads at binder points, and crown regions of the longitudinal threads are formed on a web-material contacting side, wherein on the web-material contacting side a multiplicity of deposits are provided at least on the longitudinal threads.

A woven-fabric belt which may be employed in the drying section of a paper machine, for example, is known from U.S. Pat. No. 7,172,982 B2. The woven-fabric belt is configured so as to have longitudinal threads that extend in a longitudinal belt direction which generally corresponds to a machine direction, and transverse threads that extend in a transverse belt direction which generally corresponds to a transverse machine direction. In the woven-fabric structure, the longitudinal threads bind with transverse threads, that is to say the former transect the latter, wherein crown regions of the longitudinal threads are formed in the region of these binder points, in particular crown regions are also formed on a web-material contacting side. Deposits which each are elongated in the direction of the threads on which the former are provided are provided in the region of these web-material contacting-side crown regions of the longitudinal threads and also on the respective web-material contacting side-crown regions of the transverse threads. These deposits, constructed from silicone, serve for improving the web-material guiding characteristics, wherein however, the air permeability of the belt is at the same time not to be compromised.

SUMMARY OF THE INVENTION

It is the object of the present invention to provide a woven-fabric belt for producing web material, in particular for producing spunbonded fabric, which has an improved guiding or entraining characteristic for the web material that is to be produced with a woven-fabric belt of this type.

This object is achieved according to the invention by a woven-fabric belt for producing web material, in particular for producing spunbonded fabric, comprising a plurality of longitudinal threads, running substantially in a longitudinal belt direction, and a plurality of transverse threads, running substantially in a transverse belt direction, wherein the longitudinal threads bind with the transverse threads at binder points, and crown regions of the longitudinal threads are formed on a web-material contacting side, wherein on the web-material contacting side a multiplicity of deposits are provided at least on the longitudinal threads.

It is furthermore provided herein that deposits which do not extend into the crown regions are provided, and/or that deposits which do extend into crown regions in the longitudinal belt direction are asymmetrical in relation to a respective crown region.

In the case of the woven-fabric belt according to the invention new contact or support points, respectively, for the spunbonded fabric are generated. An amplified entrainment interaction in relation to the web material to be produced is created by the deposits. To this end, deposits in regions outside the crown regions, or deposits that do not contact the crown regions, respectively, are also provided in particular, or the deposits that extend into crown regions are designed so as to be asymmetrical in relation to the crown regions, respectively.

An enlarged surface of the woven-fabric belt for the entrainment interaction with the web material to be produced may be achieved by the deposits formed in this way.

It is to be pointed out herein that the deposits that are provided on the woven-fabric belt according to the invention in the context of the present inventions are formed by material that is applied in a targeted manner onto the threads of the woven-fabric belt, and not by materials, in particular contaminants, that adhere to the thread surface in the production operation of the web material, for example.

A further reinforcement of the entrainment interaction by way of an enlargement of the surface that is provided for bearing the web material may be achieved in that deposits that contact at least two longitudinal threads that lie next to one another are provided. The regions in which deposits exist in the woven-fabric belt according to the invention are thus not limited to individual threads but also comprise surface regions that engage across threads.

It has been demonstrated that a particularly advantageous entrainment interaction for the web material to be made may be achieved when in the case of at least part of the deposits that are asymmetrical in relation to a crown region, at least 70% by volume, preferably at least 80% by volume of the deposit volume in the longitudinal belt direction is disposed on one side in relation to the crown center.

In order for a very efficient entrainment interaction by way of an enlargement of the surface to be obtained, on the one hand, and for there not to be any excessive deterioration in the surface quality of the web material to be made obtained by deposits of this type, on the other hand, it may be provided in the woven-fabric belt according to the invention that the deposits are provided with an area density in the range from 5 to 500, preferably approximately 50 to 200 deposits/cm$^2$. It is furthermore advantageous in this context for at least 80% of the deposits to have a length of extent in the longitudinal belt direction in the range from 250 to 2500, preferably approximately 1000 to 1500, μm. At least 80% of the deposits may have a maximum protrusion height beyond the supporting threads thereof in the range from 50 to 500, preferably approximately 100 to 250, μm.

For the construction of the woven-fabric structure of the woven-fabric belt according to the invention it may be provided that at least part, preferably all, of the longitudinal threads and/or transverse threads are constructed using polyester (PET) material. In order for an electrostatic charge to be prevented, part of the transverse threads may be constructed using an electrically conducting material. Herein, so-called bi-component yarns which, for example, comprise a core constructed using PA material, and a sheathing of PA material that contains so-called carbo-nanotubes, are advantageous above all.

In order for an efficient entrainment interaction to be obtained, the deposits may be constructed using silicone material or PU material.

The woven-fabric belts which are employed for making web material such as spunbonded fabrics, for example, in general in the longitudinal belt direction have an overall length that is larger than the width of said belts, that is to say larger than the length of extent in the transverse belt direction. In particular, in the case of these woven-fabric belts, the longitudinal threads are warp threads, and the transverse threads are weft threads. In order for an endless configuration to be provided, helical connection elements or a fabric seam or the like are conceivable.

The present invention furthermore relates to a method for producing spunbonded fabric using a woven-fabric belt having the previously described structure, said method comprising the application of spunbonded threads onto the web-material contacting side of the woven-fabric belt, moving in a belt-movement direction, in at least one, preferably in a plurality of, spunbonded-thread application regions which are sequential in the belt-movement direction.

The amplified entrainment interaction which is provided in the woven-fabric belt according to the invention has a particularly positive effect in the spunbonded production process, since the generally very thin spunbonded threads or filaments, respectively, that are applied in one or a plurality of spunbonded-thread application regions are very light, and there is the fundamental risk in the production process of the air turbulences that are generally also existent in the case of an overly deficient entrainment interaction causing a delamination of the spunbonded threads that have been applied onto the web-material contacting side of a woven-fabric belt of this type.

In the production method according to the invention it may be furthermore provided that at least one, preferably each spunbonded-thread application region comprises a multiplicity of spunbonded-thread extrusion nozzles, sequential in the transverse belt direction, for dispensing spunbonded threads onto the web-material contacting side of the woven-fabric belt. Thus, may be applied in a distributed manner onto the web-material contacting side in a plurality of regions in the transverse belt direction, specifically always at a location where a spunbonded-thread extrusion nozzle is provided and thus a spunbonded thread is dispensed in the extrusion process, in order for a substantially uniform spunbonded-fabric structure to be able to be produced also across the entire width of the woven-fabric belt.

According to a particularly advantageous aspect of the present invention, it is proposed that spunbonded threads that are configured with PP material on at least one thread surface are applied, and that the woven-fabric belt is moved at a speed of at least 600 m/min in the belt-movement direction, and in an upstream first spunbonded-thread application region spunbonded threads having an area weight of at most, preferably less than, 4 g/m$^2$ are applied onto the web-material contacting side of the woven-fabric belt. By way of the entrainment interaction that is achievable by the woven-fabric belt provided according to the invention there is the potential for operating at a comparatively high production speed of 600 m/min or more, but for simultaneously a comparatively minor amount of spunbonded threads to be provided in particular in the upstream first spunbonded-thread application region. This region is particularly critical since the area weight of the spunbonded fabric to be produced increases, and the risk of delamination of the spunbonded fabric produced in this way accordingly decreases, only in the subsequent spunbonded-thread application regions, that is to say in those spunbonded-thread application regions that lie further downstream. Those spunbonded threads that are applied onto the woven-fabric belt, or onto the web-material contacting side thereof, respectively, in the first spunbonded-thread application region are entrained in the belt-movement direction by the deposits that are to be provided according to the invention, without there being any substantial risk of delamination.

It may be furthermore provided in the case of the method according to the invention that spunbonded threads that are configured with PE material on at least one thread surface are applied, and that the woven-fabric belt is moved at a speed of at least 300 m/min in the belt-movement direction, and in an upstream first spunbonded-thread application region spunbonded threads having an area weight of at most, preferably less than, 8 g/m$^2$ are applied onto the web-material contacting side of the woven-fabric belt. Also in the case of the production of a spunbonded fabric of this type which on the surface thereof is constructed using PE material, by way of the application according to the invention of deposits onto a woven-fabric belt it is possible to operate at a comparatively high speed and with a comparatively low area weight of the spunbonded threads that are to be applied in the first spunbonded-thread application region, or of the layer of spunbonded threads that is produced in this way.

BRIEF DESCRIPTION OF THE SEVERAL VIEWS OF THE DRAWING

The present invention will be described in detail with reference to the appended figures in which.

DESCRIPTION OF THE INVENTION

Figure 1:
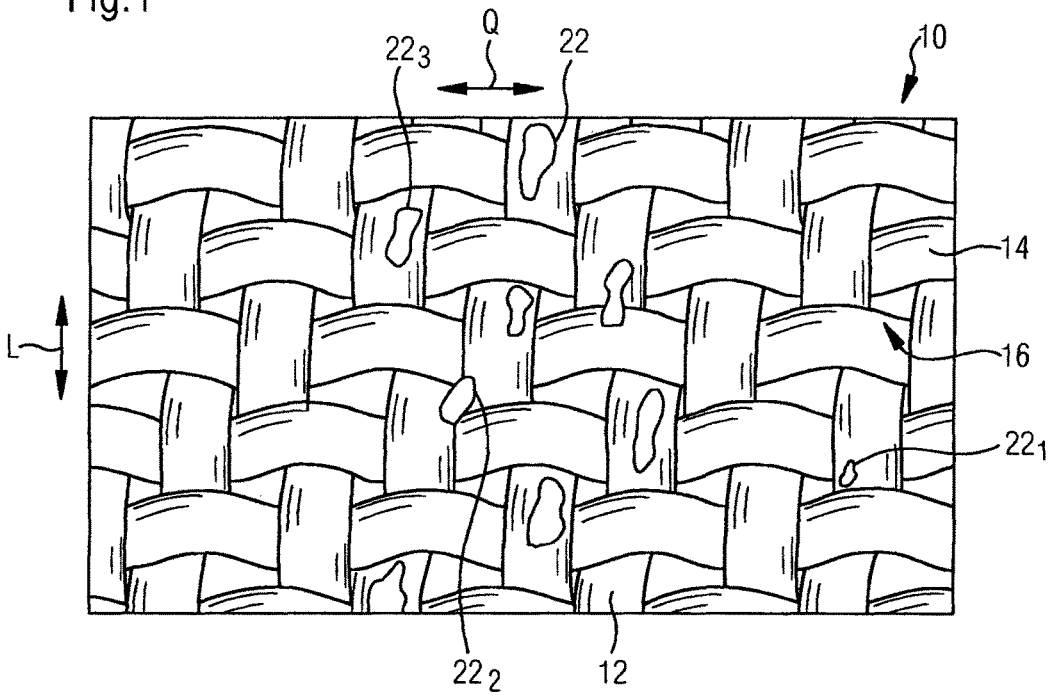
FIG. 1 shows a plan view of a part-region of a woven-fabric belt having longitudinal threads and transverse threads, and deposits which are provided thereon.

A fragment of a woven-fabric belt, generally referred to by the reference sign 10, which may be employed in an endless configuration in the production of spunbonded fabric is shown in FIG. 1. The woven-fabric belt 10 comprises a multiplicity of longitudinal threads 12, running next to one another in a longitudinal belt direction L, and a multiplicity of transverse threads 14, running next to one another in a transverse belt direction Q. Since the woven-fabric belt 10 is generally provided by way of a seam region, helical connection elements, or the like, as an endless belt, it is advantageous for the longitudinal threads 12 to be provided by warp threads, and for the transverse threads 14 to be provided by weft threads. In the spunbonded production process the woven-fabric belt 10 moves in the direction of the longitudinal threads 12, that is to say in the longitudinal direction L, the latter in this instance also corresponding to the belt-movement direction, generally speaking thus to a machine direction, while the transverse direction Q corresponds to a transverse machine direction.

A fragment of a web-material contacting side of the woven-fabric belt 10, generally referred to by the reference sign 16, is shown in FIG. 1. In the spunbonded production process, the spunbonded threads that are dispensed from spunbonded-thread extrusion nozzles are applied onto this web-material contacting side 16 in the individual spunbonded-thread application regions. Herein, a plurality of spunbonded-thread application regions that are configured in a beam-like manner, for example, and that advantageously are sequential in the belt-movement direction, that is to say the longitudinal direction L, are provided, each spunbonded-thread application region having a plurality of spunbonded-thread extrusion nozzles which are sequential in the transverse belt direction Q. A layer of spunbonded threads, also referred to as spunbonded filaments, is applied in each of the spunbonded-thread application regions, such that a spunbonded fabric having a plurality of layers of spunbonded threads, applied on top of one another, is generated at the end of this application process. The spunbonded fabric produced in this way may be lifted from the woven-fabric belt 10 and be solidified by pressing in a calendering procedure, for example.

Figure 2:
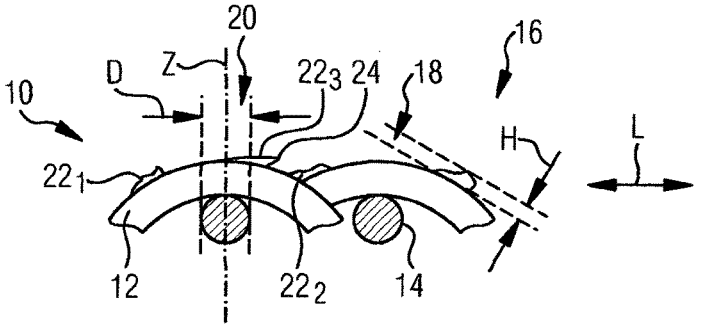
FIG. 2 shows a simplified illustration of a longitudinal section of a woven-fabric belt.
Figure 3:
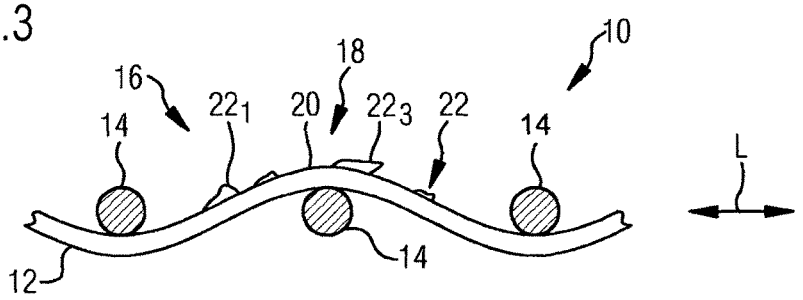
FIG. 3 shows a further, simplified longitudinal illustration of a longitudinal section of a woven-fabric belt.

As is visualized in FIG. 2, so-called binder points 18 are formed in the woven-fabric belt 10 at those locations where the longitudinal threads 12 and the transverse threads 14 transect. Herein, the two longitudinal threads 12, identifiable in FIG. 2, bind over the transverse threads 14, also illustrated, that is to say bind in relation to the transverse threads 14 on the web-material contacting side 16 that in FIG. 2 lies on top. The longitudinal threads 12 in these binder points are curved or angulated, respectively, such that crown regions 20 are created. In the context of the present invention, a crown region of this type of the longitudinal threads 12 in the longitudinal direction L extends across a distance which corresponds to the dimension in the longitudinal direction L of the transverse threads 14 that in these crown regions 20 lie below the longitudinal threads 12. In the example illustrated, having transverse threads 14 with a substantially circular cross section, this length of extent of the crown regions 20 corresponds to substantially the diameter D of the transverse threads 14.

Deposits 22, preferably constructed from silicone material, are provided on the web-material contacting side 16 of the woven-fabric belt 10. These deposits 22 which are advantageously applied by a polymer-extrusion deposition process, that is to say substantially in the manner of a screen-printing process using a rotary screen, or in the manner of a nozzle-printing procedure, adhere to the surface of in particular the longitudinal threads 12, in part also of the transverse threads 14, and generally lead to an amplified entrainment effect for the spunbonded threads that are applied onto the web-material contacting side 16.

Since the woven-fabric belt 10 in the application procedure of the deposits 22 is generally moved in the longitudinal direction L, the deposits 22 will have a contour that is substantially elongated in this production direction, that is to say in the longitudinal direction L. The deposits 22 in the case of the woven-fabric belt 10 are not only existent in the crown regions 20, but are provided in particular on the longitudinal threads 12 also between crown regions 22, specifically in such a manner that at least part of the deposits 22 that are provided between the crown regions 20 do not extend into crown regions, as is the case of the deposit $\mathbf{22}_1$ in FIG. 2, for example. The deposit $\mathbf{22}_2$ does also not extend into a crown region 20. It can be seen that this deposit $\mathbf{22}_2$ contacts two longitudinal threads 12. The deposit $\mathbf{22}_3$, identifiable in FIG. 2, also extends into a crown region 20 and in relation to the crown center Z thereof is asymmetrical in the longitudinal belt direction. It should be pointed out that the crown center Z is the longitudinal center of a respective crown region 20 in the longitudinal direction L. The deposits 22, or part thereof, respectively, have the structure that is identifiable in FIG. 2 by means of the deposit $\mathbf{22}_3$ in which a strong imbalance in relation to the crown center Z is existent. At least 70%, preferably at least 80% of the volume of this deposit $\mathbf{22}_3$ lies on one side in relation to the crown center Z in the longitudinal belt direction. This shaping, having cam-like protrusion or end regions 24, respectively, of deposits $\mathbf{22}_3$ of this type, that are formed by the strong asymmetry, may be achieved by the preceding deposition process with a production direction in the longitudinal direction L.

The deposits 22 in the case of the woven-fabric belt 10 are preferably provided so as to be distributed across the entire web-material contacting side 16 with an area density in the range from 5 to 500, preferably approximately 50 to 200, deposits/cm$^2$. As has already been mentioned above, the deposits may be provided by the deposition process so as to have a contour that is elongated in the longitudinal belt direction L, wherein at least 80% of these deposits 22 in the longitudinal belt direction advantageously have a length of extent in the range from 250 to 2500, preferably approximately 1000 to 1500, μm. In order for the envisaged entrainment effect for the spunbonded threads that are to be deposited on the woven-belt 10 to be able to be achieved, it is furthermore advantageous for at least 80% of the deposits 22 to have a maximum protrusion height H beyond the threads supporting said deposits, presently beyond the longitudinal threads 12, for example, in the range from 50 to 500, preferably approximately 100 to 250, μm.

By providing the deposits 22 on the web-material contacting side 16 of the woven-fabric belt 10, the total surface which may enter into interaction with the spunbonded threads to be entrained is enlarged, on the one hand. On the other hand, or caused by this increase in area, respectively, the surface roughness of the woven-fabric belt 10 on the web-material contacting side 16 is increased such that, for example proceeding from a roughness value Ra of 250 to 300 μm, the roughness Ra after coating or application of the deposits, respectively, may be approximately 290 to 350 μm.

By providing an amplified entrainment interaction for the spunbonded threads that are applied onto the woven-fabric belt 10, the potential for an operation of the woven-fabric belt 10 at a comparatively high speed in the belt-movement direction, generally thus in the longitudinal belt direction L, is achieved in the spunbonded-fabric production process, but also for comparatively thin layers of spunbonded threads to be applied herein in the various spunbonded-thread application regions, so as to thus also be able to produce a spunbonded fabric having a comparatively delicate structure. For example, if a spunbonded fabric is produced of which the spunbonded threads on the thread surface thereof are constructed using PP material, then using the woven-fabric belt which is provided with deposits according to the invention operation is possible at a speed of at least 600 m/min, wherein spunbonded threads having a total area weight of less than 4 g/m$^2$ may be applied onto the web-material contacting side 16 of the woven-fabric belt 10 in an upstream first spunbonded-thread application region. In this instance, further layers of spunbonded threads, having a comparable low area weight, for example, may be applied in spunbonded-thread application regions that in relation to the belt-movement direction are further downstream, such that overall a spunbonded fabric having a minor thickness and a very fine structure may be produced. Of course, spunbonded fabrics having a higher area weight, in particular also a higher area weight of the spunbonded-fabric layers that are to be applied in the individual spunbonded-thread application regions, may also be generated by employing the woven-fabric belt 10.

If a spunbonded fabric of which the spunbonded threads at least on the thread surface thereof are constructed using PE material which in relation to the threads of the woven-fabric belt 10 that are generally also constructed from polymer material has a lower coefficient of static friction is to be produced, operation at a comparatively high production speed of at least 300 m/min is nevertheless possible using the woven-fabric belt 10 as described above, wherein simultaneously, in particular in the upstream first spunbonded-thread application region, spunbonded-threads having an area weight of less than 8 g/m$^2$ may be applied without any risk of this first layer of spunbonded threads being lifted or released, caused by the turbulences that are created in the production process. While spunbonded threads that on the thread surface thereof are constructed using PP material, generally in the entire volumetric region thereof are composed of PP material, spunbonded threads that on the thread surface thereof are constructed using PE material, may either be completely, that is to say in the entire volumetric region, composed of PE material, or may be configured as so-called sheath-core threads or filaments which, for example, may comprise a core from PP material and a sheath from PE material, enveloping the former. Threads or filaments, respectively, of this type are also referred to as bi-component threads.

Using the woven-fabric belt described above, by way of the amplified entrainment interaction in particular of that spunbonded-fabric layer that is formed in the first spunbonded-thread application region that is the farthest upstream, there is the potential for operating at a comparatively high production speed in the spunbonded production process, even when only spunbonded-fabric layers having a minor area weight are applied. To this end, those deposits that generate this amplified entrainment interaction are advantageously constructed from silicone material or PU material. The longitudinal threads, or at least part of the longitudinal threads, respectively, may be provided as PET monofilaments, for example, that is to say from threads that are constructed using the same material across the entire cross section of said threads. The same applies to the transverse threads in an analogous manner. Part of the transverse threads may be constructed using electrically conducting material, in order to prevent electrostatic charges. Here, a sheath-core structure in which a core from a PA material is surrounded by a sheath of PA material containing so-called carbon-nanotubes may be provided, for example.

Of course, longitudinal threads as well as transverse threads of various types may be combined with one another in the case of the woven-fabric belt according to the invention. In particular, it is also possible for transverse threads which are electrically conductive to be integrated, so as to avoid electrostatic charges in the spunbonded production process which generally proceeds in a dry manner.

The invention claimed is:

1. A woven-fabric belt for producing web material, the belt comprising:

a plurality of longitudinal threads running substantially in a longitudinal belt direction;

a plurality of transverse threads running substantially in a transverse belt direction;

said longitudinal threads binding with said transverse threads at binder points;

crown regions of said longitudinal threads being formed on a web-material contacting side; and a multiplicity of deposits on the web-material contacting side on said longitudinal threads, and wherein the following is true:

a plurality of said deposits do not extend into said crown regions;

said deposits which do extend into said crown regions are asymmetrical in the longitudinal belt direction in relation to a respective said crown region; and substantially all said deposits have a contour that is substantially elongated in the longitudinal belt direction.

2. The woven-fabric belt according to claim 1, which comprises deposits that contact at least two said longitudinal threads that lie next to one another.

3. The woven-fabric belt according to claim 1, wherein at least 70% by volume of a deposit volume in the longitudinal belt direction of at least a part of said deposits that are asymmetrical relative to a respective said crown region is disposed on one side relative to the respective said crown center.

4. The woven-fabric belt according to claim 3, wherein at least 80% by volume of at least a part of said deposits is disposed on one side relative to the respective said crown center.

5. The woven-fabric belt according to claim 1, where said deposits are provided with an area density in a range from 5 to 500 deposits/cm$^2$.

6. The woven-fabric belt according to claim 5, where said area density lies in a range from 50 to 200 deposits/cm$^2$.

7. The woven-fabric belt according to claim 1, wherein at least 80% of said deposits have a length in the longitudinal belt direction in a range from 250 to 2500 μm.

8. The woven-fabric belt according to claim 7, wherein the length of at least 80% of said deposits lies in a range from 1000 to 1500 μm.

9. The woven-fabric belt according to claim 1, wherein at least 80% of said deposits have a maximum protrusion height beyond a respectively supporting thread in a range from 50 to 500 μm.

10. The woven-fabric belt according to claim 9, wherein the maximum protrusion height lies in a range from 100 to 250 μm.

11. The woven-fabric belt according to claim 1, where at least one of the following is true:

at least part of said longitudinal threads and/or transverse threads are constructed using polyethylene terephthalate (PET) material;

all of said longitudinal threads and/or transverse threads are constructed using PET material;

at least part of said deposits are constructed using silicone material or polyurethane (PU) material.

12. The woven-fabric belt according to claim 1, wherein said longitudinal threads are warp threads and said transverse threads are weft threads.

13. A method for producing spunbonded fabric, the method comprising:

providing a woven-fabric belt according to claim 1;

applying spunbonded threads onto the web-material contacting side of the woven-fabric belt, moving in a belt-movement direction in at least one spunbonded-thread application region.

14. The method according to claim 13, wherein the at least one spunbonded-thread application region comprises a multiplicity of spunbonded-thread extrusion nozzles, sequential in the transverse belt direction, for dispensing spunbonded threads onto the web-material contacting side of the woven-fabric belt.

15. The method according to claim 13, which comprises moving the woven-fabric belt through a plurality of spunbonded-thread application regions which are sequential in the belt-movement direction.

16. The method according to claim 15, wherein each of said plurality of spunbonded-thread application regions comprises a multiplicity of spunbonded-thread extrusion nozzles, sequential in the transverse belt direction, for dispensing spunbonded threads onto the web-material contacting side of the woven-fabric belt.

17. The method according to claim 13, which comprises applying spunbonded threads that are configured with PP material on at least one thread surface, and moving the woven-fabric belt at a speed of at least 600 m/min in the belt-movement direction, and applying in an upstream first spunbonded-thread application region spunbonded threads having an area weight of no more than 4 $g/m^2$ onto the web-material contacting side of the woven-fabric belt.

18. The method according to claim 13, which comprises applying spunbonded threads that are configured with PE material on at least one thread surface, and moving the woven-fabric belt at a speed of at least 300 m/min in the belt-movement direction, and applying in an upstream first spunbonded-thread application region spunbonded threads having an area weight of no more than 8 $g/m^2$ onto the web-material contacting side of the woven-fabric belt.

19. A method for producing spunbonded fabric, the method comprising:

providing a woven-fabric belt with longitudinal threads running substantially in a longitudinal belt direction and plurality of transverse threads running substantially in a transverse belt direction engaging one another at a plurality binder points, and wherein the longitudinal threads form crown regions on a web-material contacting side of the woven belt;

depositing a multiplicity of deposits on the web-material contacting side on the longitudinal threads, with substantially all the deposits having a contour that is substantially elongated in the longitudinal belt direction, with a plurality of deposits that do not extend into the crown regions and/or with a plurality of deposits that do extend into the crown regions being asymmetrical in the longitudinal belt direction relative to the crown region;

moving the woven belt in a belt-movement direction through at least one spunbonded-thread application region and applying spunbonded threads onto the web-material contacting side of the woven-fabric belt while moving in the at least one spunbonded-thread application region.

20. The method according to claim 19, wherein the at least one spunbonded-thread application region comprises a multiplicity of spunbonded-thread extrusion nozzles, sequential in the transverse belt direction, for dispensing spunbonded threads onto the web-material contacting side of the woven-fabric belt.

* * * * *